United States Patent [19]

Langrock

[11] Patent Number: 4,546,721

[45] Date of Patent: Oct. 15, 1985

[54] SUBMERGED SINGLE POINT MOORING SYSTEM

[75] Inventor: Donald G. Langrock, Dallas, Tex.

[73] Assignee: Mobil Oil Corporation, New York, N.Y.

[21] Appl. No.: 491,684

[22] Filed: May 5, 1983

[51] Int. Cl.[4] ..... B63B 21/00

[52] U.S. Cl. ..... 114/230; 441/2; 441/3; 441/4; 441/21

[58] Field of Search ..... 441/3, 4, 5, 2, 21; 114/230, 330, 314, 257, 339, 335

[56] References Cited

U.S. PATENT DOCUMENTS

| | | | |
|---|---|---|---|
| 1,296,689 | 3/1919 | Noah | 114/339 |
| 3,408,822 | 11/1968 | Chate | 114/335 |
| 3,800,347 | 4/1974 | Zuurbier | 441/21 |
| 4,086,865 | 5/1978 | Statham | 114/257 |
| 4,138,751 | 2/1979 | Kentosh | 114/230 |
| 4,262,380 | 4/1981 | Foolen | 114/230 |
| 4,321,720 | 3/1982 | Havre | 441/21 |
| 4,351,260 | 9/1982 | Tuson | 114/230 |

FOREIGN PATENT DOCUMENTS

| | | |
|---|---|---|
| 0076341 | 7/1981 | European Pat. Off. . |
| 1534191 | 3/1976 | United Kingdom . |

*Primary Examiner*—Trygve M. Blix
*Assistant Examiner*—C. T. Bartz
*Attorney, Agent, or Firm*—Alexander J. McKillop; Michael G. Gilman; Charles J. Speciale

[57] ABSTRACT

A mooring system for anchoring sea going ships, such as storage or production tanker vessels, and more particularly, a submerged single point mooring system fixed to the seabed and which is particularly adapted for use in arctic waters having surface hazards such as pack ice or icebergs.

8 Claims, 1 Drawing Figure

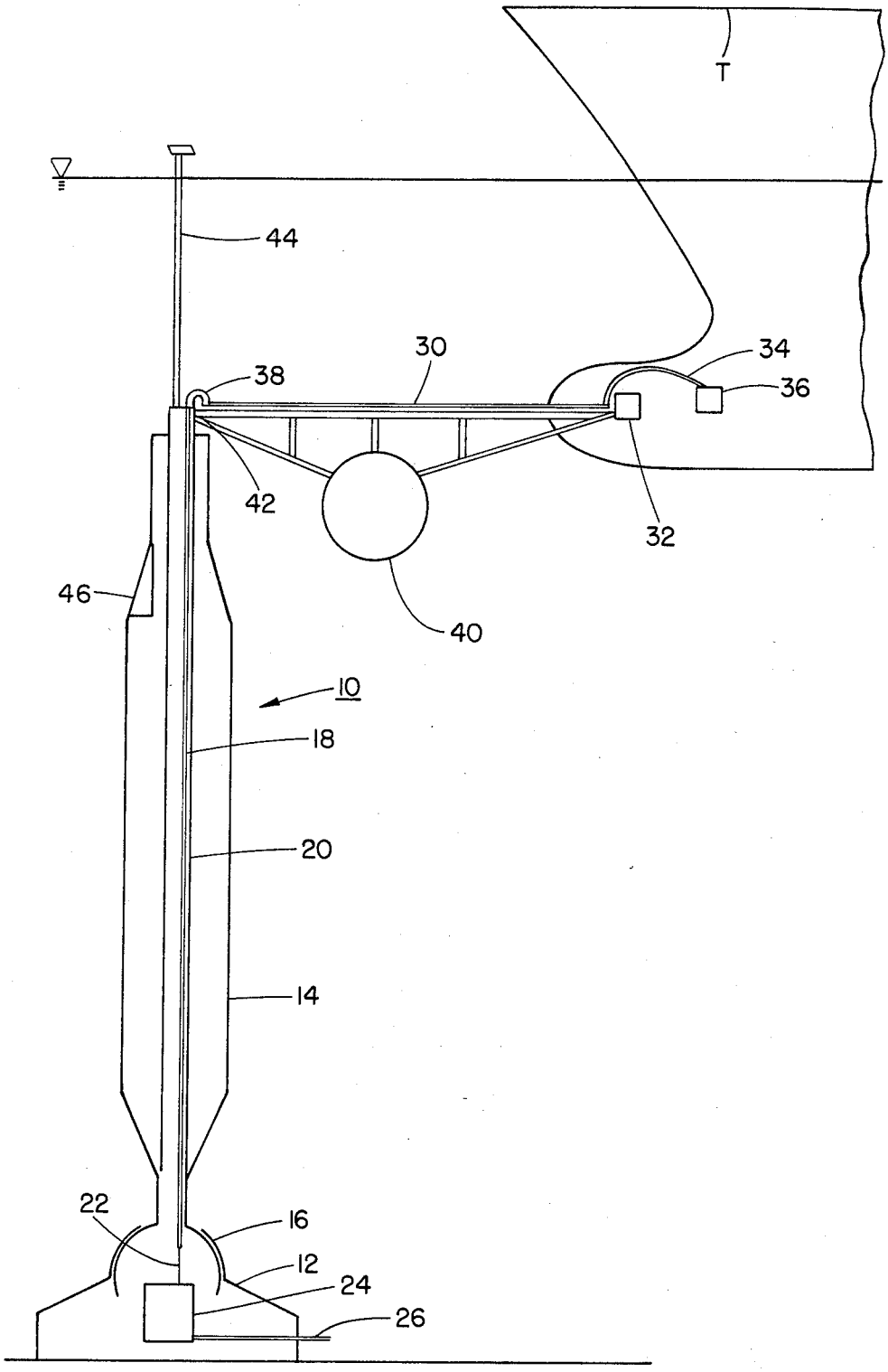
T
44
30
34
38
36
42
32
46
40
10
18
20
14
22
16
12
24
26

SUBMERGED SINGLE POINT MOORING SYSTEM

BACKGROUND OF THE INVENTION

1. Field of the Invention

The present invention relates to a mooring system for anchoring sea going ships, such as storage or production tanker vessels, and more particularly, relates to a submerged single point mooring system fixed to the seabed and which is particularly adapted for use in arctic waters having surface hazards such as pack ice or icebergs.

Various types of mooring systems have been developed to facilitate the loading and unloading of large sea going ships, such as super tankers in excess of 200,000 tons, wherein the ships have such deep drafts that natural harbors are frequently unable to accommodate them, and wherein their considerable size causes the mooring forces to reach exceedingly high levels. Accordingly, as an alternate to the construction of new natural harbors for such large ships, with all of the attendant high constructions and maintenance costs, such ships can be moored at sea in relatively deep water and the liquid cargo of the tankers may be transferred to and from the moored ships through the intermediary of underwater pipelines extending between the ship and the shore facilities.

In order to accomplish the foregoing, the various types of mooring systems have been developed so as to be adapted to readily operate under different environmental conditions and taking cognizance of different surface hazards such as ice, rough seas and congested ship traffic. Among such mooring systems there have been developed types of systems which are particularly adapted to counter the hazards present in arctic waters, such as icebergs, pack or field ice, which can cause extensive damage to or even destroy the mooring system components which project to and above the surface of the water.

2. Discussion of the Prior Art

One of the major problems in the mooring of sea going vessels, such as large tankers, in arctic waters subject to extensive ice formations can generally be overcome by constructing the mooring system to be submersible to be able to avoid surface hazards when these are encountered, and in which such mooring systems includes structural components which are elevated above the surface of the arctic or hazardous waters for only limited periods of time.

Among the mooring systems which are designed to provide for the anchoring or mooring of large vessels, such as tankers, in deep waters are the socalled pivoted tower single point mooring systems. Floory et al. U.S. Pat. No. 3,614,869 discloses such a mooring system in which a vertical column forms a support for production or flow lines and risers, and is connected by means of a ball joint to a base which is anchored to or fixed on the seabed, and wherein the upper end of the column supports a pivotable tower above the surface of the water, to which there may be readily connected a vessel, allowing the vessel to weathervane about the mooring in order to conform to different surface and weather conditions. Suitable hoses and pipelines interconnect the tower and the vessel to facilitate loading or unloading of the fluid cargo of this vessel. This type of mooring structure, although generally satisfactory for operation in relatively calm waters, is not readily serviceable in stormy arctic waters wherein extreme ice may damage or even destroy the projecting tower structure of such a mooring system.

Other single point mooring system wherein a portion of the mooring structure extends above the surface of the water are disclosed, respectively, in Tuson U.S. Pat. No. 3,980,037 and Papmahl U.S. Pat. No. 4,254,521. In each of these systems, a vertical column has its lower end pivotally hinged to a base which is fastened on the seabed, and with the upper end of the tower including an extension projecting above the surface of the water to provide for the support of a jib or boom for connecting a vessel, such as a large tanker, to the mooring. In each of these patents, the single point mooring systems are primarily adapted for operation in relatively calm waters, and in waters without surface hazards such as extensive ice commonly encountered in arctic waters which may tend to damage or even destroy the protruding structure of the mooring system.

In order to avoid the danger of damage to a mooring system for sea going ships, such as large sized tankers, which are subjected to surface hazards, such as pack ice which is encountered under arctic weather conditions, submersible tanker mooring systems have been developed wherein the systems are adapted to be operated without any structural components of the mooring systems projecting above the surface of the waters.

Frankel U.S. Pat. No. 3,664,388 discloses a submersible tanker mooring system in which a bell is adapted to be raised or lowered within a tank located in the seabed, to provide for connection to a conduit arrangement communicating with a tanker which is attached to the bell by means of a suitable anchoring cable. During the presence of heavy ice formations in the water, the bell may be lowered so as to be completely submerged beneath the surface of the water, and to thereby permit the ice to float thereover without causing any damage to the mooring structure. However, the mooring system requires a relatively complex hydraulic actuating system for the bell and, moreover, does not permit the bell to be universally articulated relative to the bottom of the seabed so as to render it incapable of absorbing large lateral forces. Additionally, the submersible bell mooring arrangement according to Frankel is of a relatively complex and cumbersome structure requiring extensive hydraulic valving during its operation and does not allow for diverless access to its interior.

Gratz U.S. Pat. No. 3,722,223 discloses a submersible single point mooring facility in which a column structure extending from an anchoring connection with a base fixed to the seabed is adapted to be raised above the surface of the water so as to allow for connection to a tanker or vessel, or submerged to lie flat on the seabed. The structure, although providing for protection of the mooring buoy against accidental impact by passing ships or damage from surface ice, is normally raised above the surface of the water during operation and thus is not designed for extended or protracted use beneath the surface of the arctic waters. Additionally, the structure of this submersible single point mooring facility is rather complex and does not provide for diverless access to the interior of the mooring facility.

Similarly, Lecomte U.S. Pat. No. 3,899,990 discloses a mooring system with submersible column which is pivotally anchored to a base fixed to the seabed, and which may be raised above the surface of the water in order to allow for connection to a vessel on the surface.

In this instance, the structure of the system is in a raised position to project above the water surface and is not accessible without the utilization of a diver under normal operating conditions.

SUMMARY OF THE INVENTION

Accordingly, the present invention contemplates the provision of a submerged single point mooring system wherein a generally vertical column, which is adapted to house a plurality of risers and an access tunnel, is pivotally anchored to a base fastened to the seabed through the intermediary of a spherical bearing allowing for the articulation and rotation of the vertical column, relative to the base. The upper end of the vertical column, which terminates below the water surface, is equipped with a universal joint which will facilitate weathervaning movement of a vessel fastened thereto through the intermediary of a fully submerged boom, through suitable flexible cables and connectors leading to the lower or submerged portion of the vessel hull to thereby permit ice or other potential hazards to freely pass over the mooring system, rendering the latter capable for extended use in arctic regions or in other locations wherein extensive pack or field ice is present. Inasmuch as the upper end of the column is fitted with the universal joint which also allows for movement of a moored vessel in pitch and roll modes, as well as surge and sway, as produced under severe surface weather conditions, and since the spherical bearing at the bottom end of the vertical column allows for articulation and rotation of the column relative to the base, the need for a rotating joint or platform at the upper end of the column is eliminated.

In accordance with the inventive concept, the upper end of the vertical column includes a retractable column extension which, at its upper end, is provided with a vent and service access port to allow for diverless access to the interior of the mooring system when the column extension is in its raised projecting extending above the surface of the water, and with the interior of the vertical column and the spherical bearing being under generally atmospheric conditions. During use of the mooring system, the upper column extension is normally retracted into the vertical column below the water surface so as to avoid any structural components of the mooring system being damaged by hazards or ice on the surface of the water.

In a particular aspect of the invention, the pivotal interconnection between the lower end of the vertical column and the base which is fixed to the seabed is in the form of a spherical bearing containing an atmospheric chamber accessible through the vertical column, and wherein the spherical bearing is designed to be primarily under tension rather than normal compression loads to which such a bearing is generally subjected in order to improve upon the service function thereof.

The base may also contain a suitable multipass swivel connected to flow lines leading to and from subsea wells or from production platform or a vessel, with the swivel connecting to the vertical risers in the column through the intermediary of flexible pipes in order to allow for rotation of the column while providing for a constant connection to the production or flow lines.

Accordingly, it is a primary object of the present invention to provide a single point mooring system for seagoing ships which is particularly adapted for use in hazardous and arctice waters.

It is a more specific object of the present invention to provide a submerged single point mooring system for seagoing ships, such as storage or production tanker vessels, which is entirely submerged so as not to be exposed to surface hazards of arctic waters, and which includes a diverless access provided by a column extension adapted to be elevated above the surface of the water for servicing and access to the interior of the mooring system.

Still another object of the present invention is to provide a submerged single point mooring system in which a vertical column is pivotally mounted on a base fixed to the seabed, with the column terminating at a distance below the surface of the water, and including a boom which is entirely submerged and which is adapted to be fastened to the lower portion of a vessel hull so as to be secure from hazards on the surface of the water, with an extendable and retractable column component being raisable above the surface of the water to provide for diverless access to the interior of the mooring system.

BRIEF DESCRIPTION OF THE DRAWING

The foregoing and other more specific objects and features of the invention may be more readily ascertained from the following detailed description of a preferred embodiment of a submerged single point mooring system pursuant to the invention, taken in conjunction with the accompanying single figure of drawings.

DETAILED DESCRIPTION

As illustrated in the drawing, the submerged single point mooring system 10 includes a suitable base 12 which is firmly fixed or anchored to the seabed, in this instance, the seabed of arctic waters. A hollow vertical column 14 which may be constructed, as is well known in the art, of either steel or concrete is supported on the base 12 through the intermediary of a bearing structure 16. In this instance, the bearing structure 16 consists of a spherical bearing formed of polytetrafluorethylene hydrostatic segmented bearings which will facilitate replacement of various bearing elements while maintaining the single point mooring arrangement in operation. Furthermore, the construction of the bearing from PTFE, or with at least the surfaces thereof being coated therewith, will permit the bearing to operate without damage in the case of loss of lubricating oil. Normally, the spherical bearing is supplied by a redundant lubricating system which provides the spherical hydrostatic bearing segments with sufficient tensile pressure to prevent bearing surface contact. The utilization of a spherical bearing as the interconnection between the lower end of the vertical column 14 and the base 12 allows the vertical column to be articulated and rotated relative to the base, thereby eliminating the requirement for the provision of a rotating joint at the top of the column.

Extending upwardly from the base 12 through the vertical column 14 are a plurality of risers 18 and an access tunnel 20, which risers connect at their lower ends, through the intermediary of a flexible conduit 22, to a multipass swivel 24 to allow for rotation of the vertical column 14 relative to flow lines 26 extending along the seabed and which connect with subsea wells or production platforms or vessels.

At the upper end of the vertical column 14, the latter of which terminates well below the surface of the waters, for instance 30 to 40 feet below the surface, there may be mounted a suitable boom 30 which is adapted to extend generally horizontally and fully submerged towards a vessel or tanker T, having an attachment member 32 for fastening the boom 30 to the hull of the vessel. Suitable flexible hoses and piping 34 extend along the boom 30 and may be connected at 36 to the interior of the vessel T by means of a suitable hull fittings, and at their other end may connect through a flexible hose or swivel 38 to the risers 18 so as to allow for flow of liquid cargo to and from the flow lines and the tanker vessel T.

If desired, the boom 30 may be provided with at least one buoyancy chamber 40 in the event that sufficient buoyancy is not provided in the vertical column 14 to maintain the latter generally upright condition. Universal joint 42 may be arranged at the upper end of the vertical column 14 at its point of connection with the boom 30 so as to allow movements of the tanker vessel T in pitch and roll, as well as surge and sway. Inasmuch as the vertical column 14 is permitted to rotate at is bottom end relative to the base 12, there is no requirement for a rotating joint to be arranged at the top of the vertical column of 14.

In order to provide for diverless access to the interior of the mooring arrangement 10, a retractable column extension or vent pipe and service access 44 is provided which is adapted to telescopingly retract into the column 14 during normal use of the single point mooring arrangement so that no structure will extend towards and above the surface of the waters, thereby eliminating any possible surface hazard from damaging the mooring system.

In the event it is desired to service the interior of the mooring arrangement 10, the telescoping retractable column extension 44 may be extended upwardly, possibly by providing a suitable hydraulic unit (not shown) within the mooring system, so that its upper end will extend above the surface of the waters. A suitable hatch may be provided to allow for service access to the interior of the mooring system, whereby the spherical bearing may be serviced through the intermediary of an atmospheric chamber contained within the bearing.

In the event that the retractable column extension 44 is inoperative, and it is desired to enter the mooring arrangement 10, a suitable diver access and air lock 46 may be provided on the vertical column 14, with access being provided to the access tunnel within the single point mooring system.

Suitable power for lubrication pumps, lighting, ventilation systems and other facilities within the mooring system may be provided through an umbilical cord leading from the floating vessel T. Moreover, slip rings and other devices may be provided in conjunction with the multipass swivel, as is well known technology.

From the foregoing, it clearly appears that the submerged single point mooring system pursuant to the present invention is clearly unique in that it is adapted, in a simple manner, to allow ice to pass over the mooring system during normal operation thereof to thereby render it capable for use in arctic regions and other locations having the presence of pack or field ice. Inasmuch as the mooring boom 30, which is fully submerged, attaches to the lower hull portions or submerged bottom portions of the vessel T, or to extensions therefrom, the piping, flexible members, the vertical column 14 and the boom 30 are all located well below the water surface, and harmful contact with floating ice and other surface hazards is clearly avoided. Generally, the floating tanker vessel T which is attached to the boom is used as a floating storage or production vessel.

While there has been shown and described what are considered to be preferred embodiments of the invention, it will of course be understood that various modifications and changes in form or detail could readily be made without departing from the spirit of the invention. It is therefore intended that the invention be not limited to the exact form and detail herein shown and described, nor to anything less than the whole of the invention herein disclosed as hereinafter claimed.

What is claimed is:

1. A submerged single point mooring system for sea going ships, such as storage or production tanker vessels, particularly for use in arctic waters, comprising:

(a) a base affixed to the sea bed;

(b) a bouyant vertical column extending from said base to a level below the surface of said waters;

(c) a spherical bearing interconnecting said base and the lower end of said vertical column to facilitate articulation and rotation of said vertical column relative to said base;

(d) a boom extending from the upper end of said vertical column, said boom being entirely submerged beneath the surface of said water;

(e) universal joint means interconnecting the upper end of said vertical column and the adjoining end of said boom;

(f) and a telescoping column extension normally retracted into the upper end of said vertical column, said column extension being upwardly extendable so as to project above the surface of said waters to allow for diverless access to the interior of said column for the inspection and servicing of said column.

2. A mooring system as claimed in claim 1, said spherical bearing being a polytetrafluorethylene hydrostatic segmented bearing.

3. A mooring system as claimed in claim 1, said spherical bearing being subjected to tensile stresses responsive to the buoyant forces acting on said vertical column.

4. A mooring system as claimed in claim 1, said boom having means at the distal end relative to said vertical column forming a connection to a submerged hull portion of a vessel, flexible conduit means interconnecting risers in said vertical column with conduit means communicating with a submerged inlet connection in the vessel hull.

5. A mooring system as claimed in claim 1, comprising a multipass swivel in said base connecting with production and flow lines extending along said seabed to allow for rotation of said vertical column relative to said base.

6. A mooring system as claimed in claim 1, comprising a buoyancy chamber on said boom for maintaining the predetermined position thereof below the surface of said waters.

7. A mooring system as claimed in claim 1, comprising diver access and airlock means being provided in the upper portion of said vertical column.

8. A mooring system as claimed in claim 1, said telescoping column extension in the extended condition thereof above the surface of said waters forming a vent pipe and diverless service access to the interior of said vertical column.

* * * * *